US007690287B2

(12) United States Patent
Maegerlein et al.

(10) Patent No.: US 7,690,287 B2
(45) Date of Patent: Apr. 6, 2010

(54) EXPLOSIVE NEUTRALIZER AND METHOD

(76) Inventors: Stephen D. Maegerlein, 52 Kern St., P.O. Box 6A, Williams, IN (US) 47470; Gary L. Broxton, 4075 S. Judee Dr., Bloomington, IN (US) 47401

( * ) Notice: Subject to any disclaimer, the term of this patent is extended or adjusted under 35 U.S.C. 154(b) by 697 days.

(21) Appl. No.: 11/488,497

(22) Filed: Jul. 18, 2006

(65) Prior Publication Data

US 2009/0038496 A1 Feb. 12, 2009

(51) Int. Cl.
*F42B 33/00* (2006.01)

(52) U.S. Cl. ..... 86/50

(58) Field of Classification Search ..... 86/50; 89/1.11; 102/202.1, 202.2
See application file for complete search history.

(56) References Cited

U.S. PATENT DOCUMENTS 3,327,628 A * 6/1967 Loprest et. al. ..... 86/50
3,696,747 A 10/1972 Kissinger
3,750,527 A * 8/1973 Heinemann ..... 86/1.1
3,765,331 A 10/1973 Montesi
3,765,332 A 10/1973 Baker et al.
4,196,668 A * 4/1980 Morlock et al. ..... 102/473
4,205,588 A * 6/1980 Phillips ..... 89/1.11
4,311,097 A 1/1982 Backstein et al.
4,487,126 A 12/1984 Schaper
4,658,726 A 4/1987 Held
5,194,687 A * 3/1993 Garfinkle ..... 89/1.11
5,243,915 A * 9/1993 Paech ..... 102/425
5,373,790 A * 12/1994 Chemiere et al. ..... 102/226
5,511,482 A * 4/1996 DiPietropolo ..... 102/426
5,932,834 A * 8/1999 Lyon et al. ..... 102/226
5,939,662 A 8/1999 Bootes et al.
6,131,516 A 10/2000 Sanford et al.
6,363,854 B1 4/2002 Schweitzer
6,405,626 B1 * 6/2002 Bureaux et al. ..... 86/50
6,539,872 B2 4/2003 Pipkin
2002/0134271 A1 * 9/2002 Duparc et al. ..... 102/374
2005/0222484 A1 * 10/2005 Eidelman et al. ..... 588/403
2007/0101890 A1 * 5/2007 Pervan ..... 102/426
2007/0261585 A1 * 11/2007 Chamlee et al. ..... 102/255
2007/0261586 A1 * 11/2007 Chamlee et al. ..... 102/259

* cited by examiner

*Primary Examiner*—Bret Hayes
(74) *Attorney, Agent, or Firm*—Liell & McNeil

(57) ABSTRACT

An explosive device includes a firing train, an explosive charge and a shock activated neutralizer configured to disable activation of the explosive charge by the firing train. The neutralizer includes a housing and a rupturable fluid barrier configured to selectively permit mixing of disabling material constituents to interact with the firing train to disable the same. A method of neutralizing an explosive device includes rupturing the fluid barrier, at least in part by applying a shock to the explosive device, and interacting the disabling material with the firing train to disable the same.

19 Claims, 3 Drawing Sheets

EXPLOSIVE NEUTRALIZER AND METHOD

STATEMENT OF GOVERNMENT INTEREST

The United States Government has certain rights in the present patent application, and any patent that may issue thereon, under Contract Number FA8651-05-C-0112.

TECHNICAL FIELD

The present disclosure relates generally to neutralizers for explosive devices, and relates more particularly to an impact shock activated neutralizer configured to disable a lead energetic material of an explosive device firing train with a disabling material via rupturing of a fluid barrier.

BACKGROUND

Most conventional explosive devices such as explosive weapons are configured to detonate at a predetermined time or under predetermined conditions, by dropping the device, for example, or via relatively highly sophisticated ignition timing and/or triggering means. As is well known throughout the world, however, explosive devices do not always detonate when desired, often due to failure of the firing mechanism or the absence of expected conditions conducive to detonation. Unexploded explosives can present a danger to all persons who may happen to come into contact with them during a military operation, and even decades after suspension or resolution of an armed conflict. In particular, disposal personnel and non-combatants may be exposed to a substantial risk of death or dismemberment when engaging in activities within an initially failed explosive's zone of action. Even though explosives may fail to explode as intended, the explosive charge(s) and firing mechanisms may remain susceptible to activation by a variety of external forces such as heat, mechanical shock and other means. Cluster bombs, which may leave numerous unexploded and widely dispersed bomblets, pose a particular threat to non-combatants residing in armed conflict zones. The global benefits of fail-safe mechanisms for explosive devices are clear.

Over the years, various systems have been proposed to address the foregoing problems. U.S. Pat. No. 6,539,872 to Tipkin represents one such strategy and is directed to fuze "sterilization" using a sacrificial anodic component. Tipkin proposes a method of fuze sterilization wherein a first component and a second component having a prescribed relationship required for proper detonation of the fuze are positioned in a fuze device. The first and second components are fabricated from materials having different galvanic potentials. An electrolyte introduced between the first and second component initiates galvanic corrosion of one of the components, which may continue for a period of time until the prescribed relationship between the first and second components changes sufficiently to disable the detonation operation of the fuse. While Tipkin may be applicable to certain types of explosives and in certain environments, its passive fuze disabling approach is not without shortcomings.

The present disclosure is directed to one or more of the problems or shortcomings set forth above.

SUMMARY OF THE INVENTION

In one aspect, the present disclosure provides a neutralizer for a firing train and the like of an explosive device. The neutralizer includes a housing adapted to couple with a portion of a firing train assembly and having therein a chamber for containing a disabling material. The neutralizer also includes a rupturable fluid barrier configured to inhibit interacting disabling material with the firing train. The barrier is configured to rupture responsive to an impact shock on the neutralizer to permit interacting of disabling material with the firing train to disable the same.

In another aspect, the present disclosure provides an explosive device including a firing train, an explosive charge and an impact shock activated neutralizer. The neutralizer is configured to disable activation of the explosive charge, and includes a housing and a rupturable fluid barrier configured to selectively permit interacting of disabling material with the firing train to disable the same.

In still another aspect, the present disclosure provides a method of neutralizing an explosive device. The method includes rupturing a fluid barrier configured to inhibit interacting of a disabling material with a firing train of the explosive device, at least in part by applying a shock to the explosive device. The method also includes interacting the disabling material with the firing train of the explosive device to disable the same.

DETAILED DESCRIPTION

Figure 1:
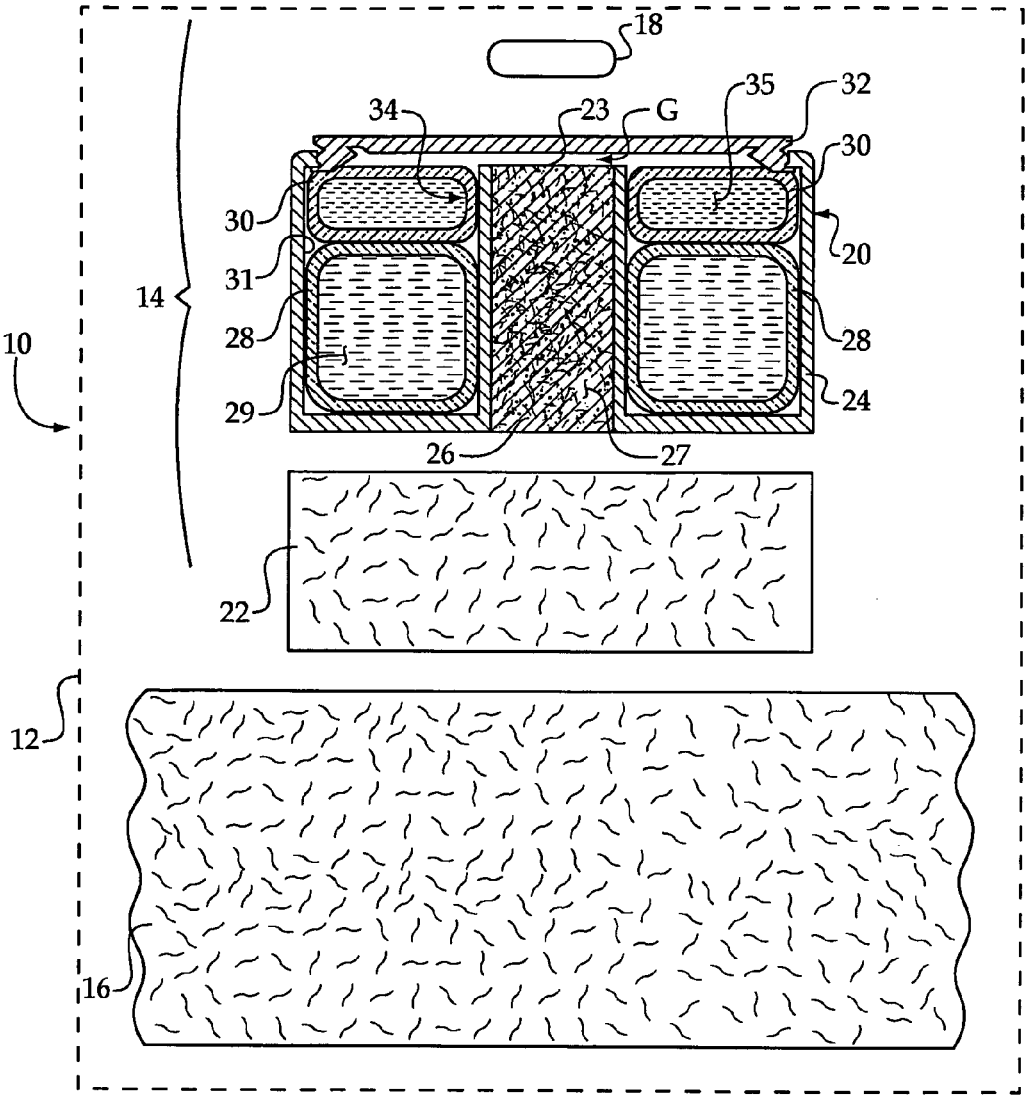
FIG. 1 is a partially sectioned side view of an explosive device according to one embodiment of the present disclosure.

Referring to FIG. 1, there is shown an explosive device 10 according to one embodiment of the present disclosure. Explosive device 10 may include at least one housing 12 having therein a firing train assembly 14 and a main charge 16. Firing train assembly 14 may include a detonator 18, a neutralizer 20 and a booster charge 22. Neutralizer 20 may comprise a shock activated neutralizer configured to directly or indirectly disable activation of main charge 16 when explosive device 10 does not explode when intended. Where explosive device 10 consists of an aerial bomb, missile, shell or similar relatively long-range explosive device, the shock which activates neutralizer 20 may consist of the impact shock experienced by explosive device 10 upon striking a target. In alternative embodiments, for example where explosive device 10 consists of a stationary, mechanically or electronically triggered explosive, a different means for applying a shock may be employed. For instance, where explosive device 10 consists of a mine, a mechanically actuated trigger might be used to apply an impact shock to neutralizer 20 to activate the same. The present disclosure is contemplated to provide substantial improvements in neutralizing unexploded explosive devices via a variety of structural and operational designs, as further described herein.

In the embodiment of FIG. 1, neutralizer 20 is configured to mechanically inhibit operation/activation of firing train 14. Neutralizer 20 may include a housing 24 having therein a compartment 27 wherein a lead energetic material or lead 26 is disposed. Detonator 18 may be configured to act upon lead 26 to activate the same in a conventional manner, such that lead 26 may in turn activate booster material 22 to explode main charge 16. A wide variety of lead energetic materials are known in the art and available from commercial sources, and the present disclosure is not limited to any one material type or even class of material types. A variety of lead configurations may be implemented within the context of the present disclosure, including pressed disks of lead material, loose packed granular lead material or another lead material configuration. Similarly, the materials selected for booster 22 and main charge 16 may be any suitable explosive materials.

Housing 24 of neutralizer 20 may further include another compartment 31 wherein a disabling material is disposed which, upon activation of neutralizer 20, can interact with firing train 14 to disable the same. To this end, at least one reactant vessel, for example first and second reactant vessels 28 and 30 may be disposed within compartment 31. Housing 24 may comprise a substantially cylindrical metallic body configured such that compartment 27 provides a substantially cylindrical space wherein lead energetic material 27 is disposed. Compartment 31 may provide another substantially cylindrical space generally coaxial with and extending about compartment 27. First and second reactant vessels 28 and 30 may also comprise generally cylindrical, hollow bodies, for example being generally doughnut-shaped, which are configured to fit within compartment 31 and around compartment 27 and stack one on top of the other. In an alternative embodiment, reactant vessels 28 and 30 could be generally C-shaped, each fitting into a portion of compartment 31 in a side-by-side manner. First reactant vessel 28 may define a first chamber 29 having therein a first constituent of disabling material, whereas second reactant vessel 30 may define a second chamber 35 having therein a second constituent of disabling material. It should be appreciated that embodiments are contemplated wherein, rather than separate reactant vessels 28 and/or 30, the chamber(s) which contain disabling material might be defined by housing 24 itself. For instance, disabling material capable of interacting with lead material 26 might be stored directly in compartment 31 and selectively permitted to interact with lead material 26, in a manner described herein. In one embodiment, reactant vessels 28 and 30 may comprise rupturable glass ampules, each fluidly containing a constituent of the disabling material, the significance of which is further described herein.

Neutralizer 20 may further comprise a rupturable fluid barrier configured to normally inhibit interacting of disabling material stored within neutralizer 20 with firing train 10. In other words, during storage and normal handling of explosive device 20, the rupturable fluid barrier will prevent interacting of the disabling material with firing train 14. As used herein, the term "rupturable" should be understood to mean that the fluid barrier can rupture more readily than other components of housing 24. In other words, the fluid barrier will typically be configured to rupture responsive to an impact shock on explosive device 10 and/or neutralizer 20 that will not rupture housing 24 itself.

In the embodiment shown in FIG. 1, reactant vessels 28 and 30 comprise the rupturable fluid barrier. In other words, walls of reactant vessels 28 and 30 are configured to rupture responsive to a shock, by colliding with one another, colliding with internal walls or other structures of housing 24, or by collapsing responsive to a sufficiently strong inertial shock. Reactant vessels 28 and 30 may be fabricated according to Military Standard 1316 (Mil-STD-1316), indicating generally that certain explosives components shall not be damaged or otherwise functionally altered via the forces experienced from a five feet or higher drop onto a hard surface. In alternative embodiments, for instance, where disabling constituents are stored directly in compartment 31 of housing 24, the rupturable barrier might comprise a single wall between the constituents, or between the disabling material and lead material 26. Second reactant vessel 30 may further include a weakened wall 34 comprising the rupturable fluid barrier configured to permit disabling material to exit reactant vessel 30. First reactant vessel 28 could similarly be configured with a weakened wall (not shown). Where reactant vessels 28 and 30 are generally uniform, i.e. without weakened portions, the rupturable fluid barrier may comprise the entirety of each of reactant vessels 28 and 30.

As alluded to above, neutralizer 20 is configured to mechanically interact with firing train 14, in particular lead material 26, to disable explosive device 10. To this end, neutralizer 20 may include a displaceable covering 32 extending over an end 23 of compartment 27. Displaceable covering 32 may comprise a metallic panel, for example a corrugated panel, or another covering such as a bellows that is configured to move via stretching, unfolding, etc., responsive to intrusion of activated disabling material into a gap G between lead material 26 and covering 32.

Figure 2:
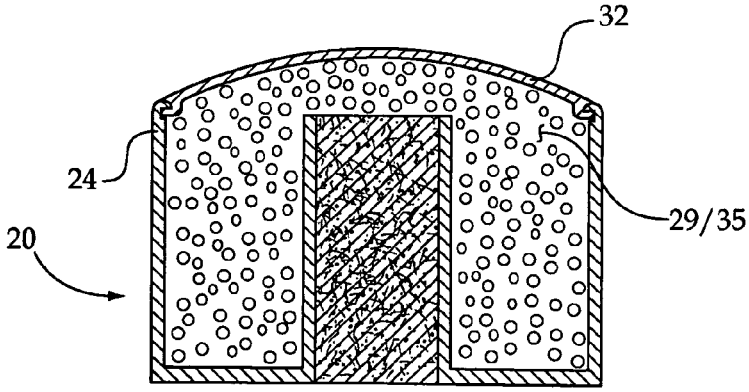
FIG. 2 is a sectioned side view of a neutralizer device illustrated in an activated state, according to one embodiment of the present disclosure.

Turning to FIG. 2, there is shown neutralizer 20 approximately as it would appear in an activated state, wherein disabling material has intruded between covering 32 and lead material 26. Activating of disabling material constituents stored in chambers 29 and 35 can effectively generate a mechanical barrier to stop the active effects of detonator 18 on lead material 26. To this end, the disabling material may comprise a foamable, curable material such as liquid polyurethane and an activator material such as water, which together can react, generating an expanding foam that pushes covering 32 upwardly. The foam may in turn cure and thereby form a hardened, permanent barrier to disable firing train 14 and thus explosive device 10.

Figure 4:
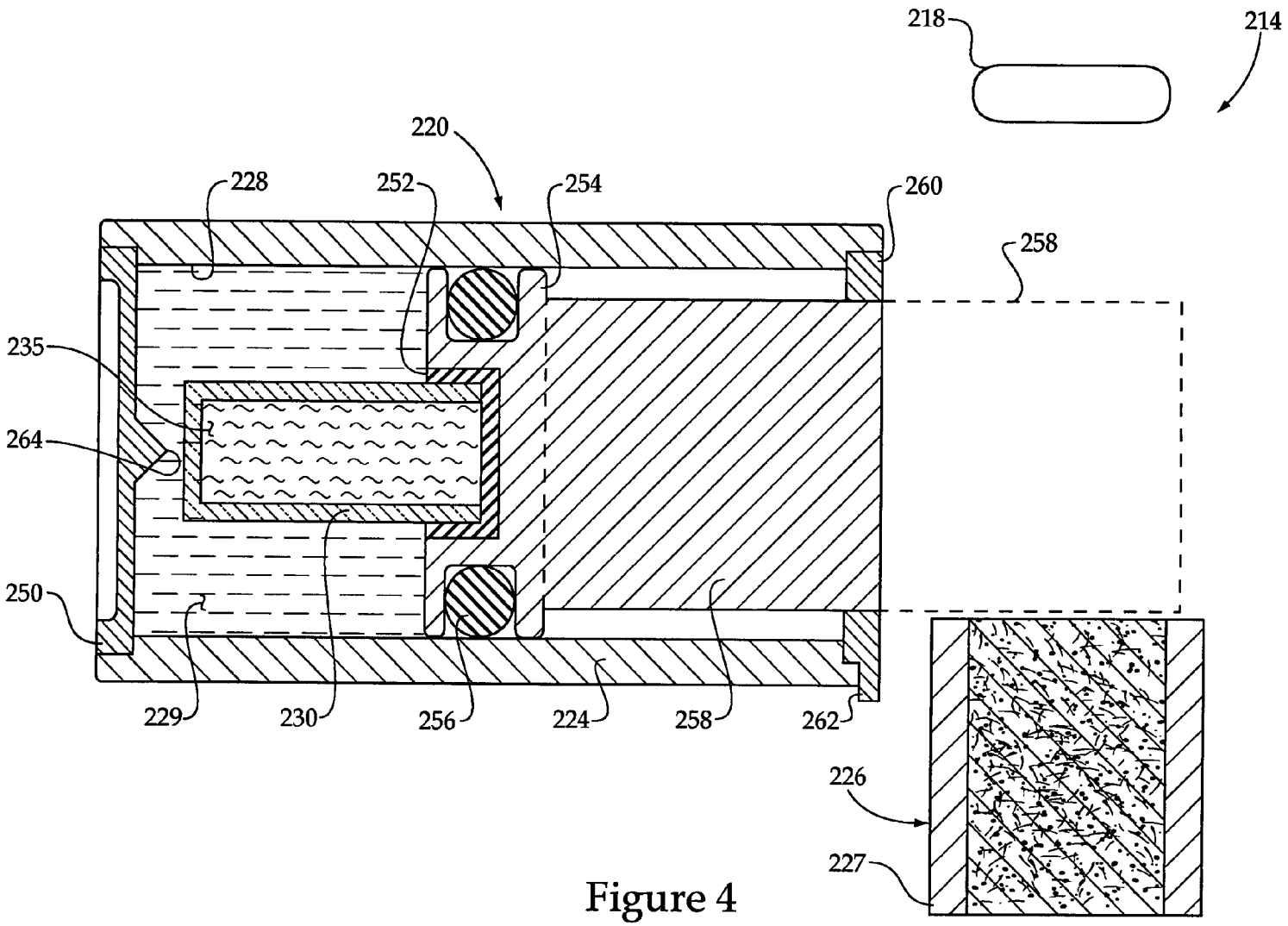
FIG. 4 is a sectioned side view of a portion of an explosive device according to yet another embodiment of the present disclosure.

Turning to FIG. 4, there is shown a portion of another explosive device having a firing train 214, according to another embodiment of the present disclosure. Firing train 214 may include a detonator 218 similar to detonator 18 of the FIG. 1 embodiment, and may further also include a lead 226 having lead energetic material stored within a lead housing 227. Firing train 214 also includes a neutralizer 220, having certain similarities with neutralizer 20 of FIG. 1, but also important differences. Like neutralizer 20, neutralizer 220 is configured to mechanically inhibit its associated firing train 214. Neutralizer 220 also includes a displaceable element, however, rather than a displaceable covering or the like as in neutralizer 20, the displaceable element of neutralizer 220 may comprise a single stroke piston 258 configured to move responsive to activation of expanding foaming material which moves piston 258 to block action of detonator 218 on lead 226. An approximate displaced position of piston 258 is shown in phantom in FIG. 4, such that it will intercept activation output of detonator 218 prior to acting on lead 226.

Piston 258 may be positioned within a housing or body 224 having a piston guide plate 260 at one end thereof, with a tang 262 for assisting in assembling neutralizer 220 and/or mounting with a portion of firing train 214. Piston guide plate 260 may comprise an aperture (not shown) that is generally complementary to piston 258 such that when piston 258 moves to a position at which it blocks activating of detonator 218, it can be readily and reliably guided. Piston 258 may further comprise a sealing portion 254 also configured to assist in guiding travel of piston 258, but also providing a fluid seal for a first chamber 229 in cooperation with an O-ring 256, for example. First chamber 229 may comprise a chamber for containing a constituent of disabling material, defined by internal walls 228 of housing 224. Neutralizer 220 may also include a second chamber 235 for containing another constituent of disabling material, for example defined by a reactant vessel 230. Reactant vessel 230 may comprise a glass vessel such as an ampule, and may also include a rupturable fluid barrier configured to rupture responsive to an impact shock on neutralizer 220 such that constituents contained within chambers 235 and 229 can mix and activate to interact with and disable firing train 214. Reactant vessel 230 may be mounted to piston 258 via a seat 252, which may comprise a fluidly sealed seat, forming a seal on an open end of reactant vessel 230.

Neutralizer 220 may further include a base plate 250 having a strike point or nose 264 configured to break reactant vessel 230 when a shock is applied to neutralizer 220. In one embodiment, piston 258 may have enough freedom of movement within housing 228 to allow nose 264 and reactant vessel 230 to contact when a sufficient impact shock is applied to neutralizer 220. In other embodiments, base plate 250 might itself move to rupture reactant vessel 230, or some other means of rupturing reactant vessel 230 and its associated rupturable fluid barrier might be provided.

A first constituent of disabling material, such as a foamable, curable material similar to that described above with regard to neutralizer 20 may be positioned within chamber 229. A second constituent, such as an activator material, also similar to that described above with regard to neutralizer 20, may be positioned within chamber 235 such that upon rupturing of the fluid barrier separating the respective chambers, an expanding foam may be generated to drive piston 258 toward the position shown in phantom at which it blocks acting of detonator 218 on lead 226. Subsequent curing of the foamed disabling material will substantially lock piston 258 in its blocking position. In either of the presently described embodiments utilizing a foamable, curable material, the cured foam may occupy approximately one to two times its original, uncured volume.

Figure 3:
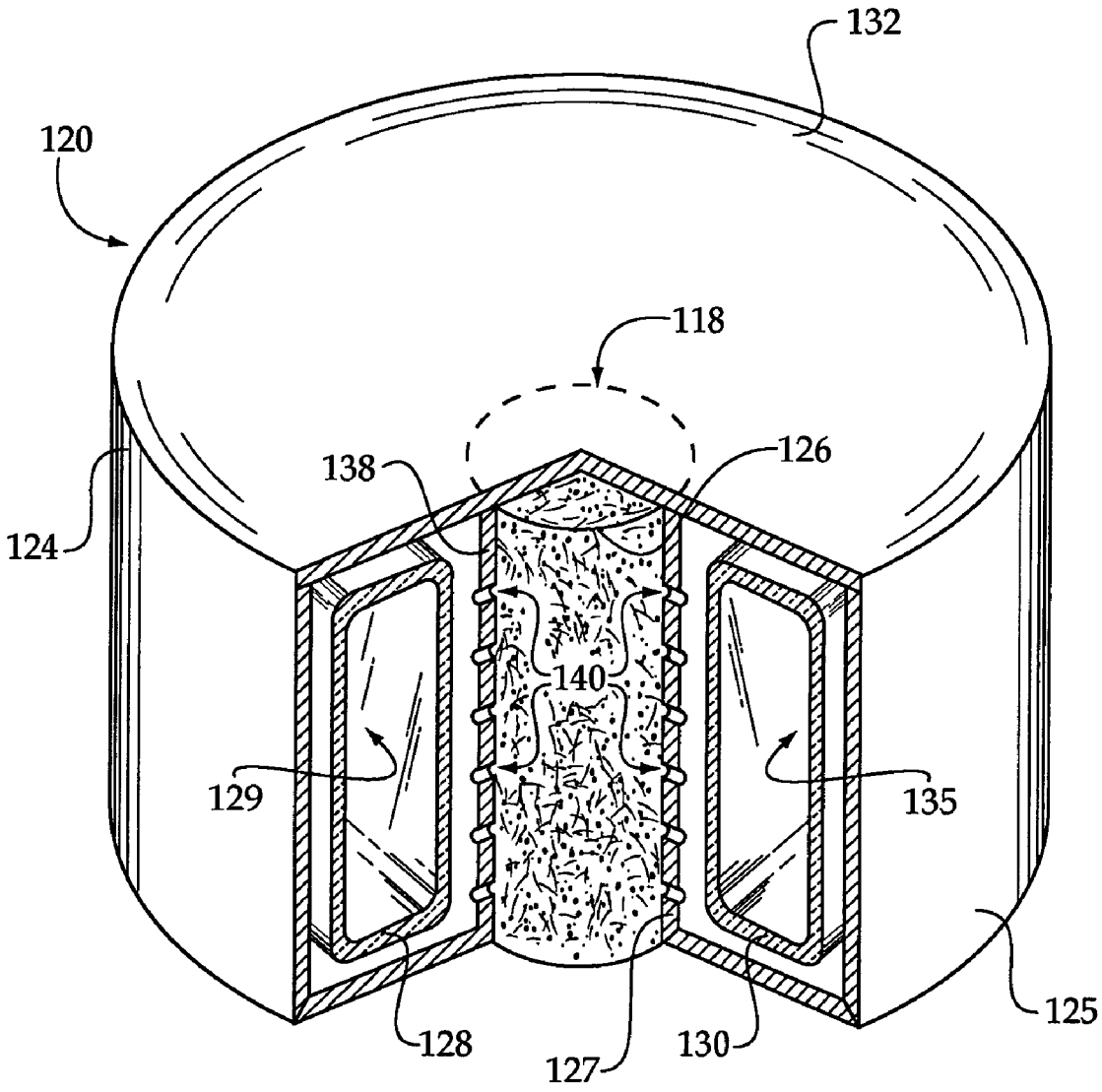
FIG. 3 is a cut-away view, in perspective, of a neutralizer device according to another embodiment of the present disclosure.

Turning now to FIG. 3, there is shown a neutralizer 120 according to yet another embodiment of the present disclosure. It should be appreciated that although neutralizer 120 is shown in the particular context of a specific embodiment, the general design and configuration of certain of its components may be similar to that implemented in neutralizer 20 of FIG. 1. Neutralizer 120 shares certain features with the foregoing embodiments, namely, in that neutralizer 120 is impact shock activated, but also has important differences, particularly in that neutralizer 120 is configured to chemically disable activation of a lead material 126 with a detonator.

Neutralizer 120 may include a housing 124 comprising a generally cylindrical periphery or peripheral wall 125, and also including an internal wall 127. Housing 124 may include a cover plate 132 defining a detonator strike zone 118 corresponding generally to a position of lead 126 in housing 124. A first reactant vessel 128 and a second reactant vessel 130 may be disposed in a space or chamber defined between wall 127 and peripheral wall 125, and defining first and second chambers 129 and 135, respectively. Each of reactant vessels 128 and 130 may be configured to rupture responsive to a shock on neutralizer 120 such that their contents can mix and interact with lead 126 to disable the same. Thus, each of reactant vessels 128 and 130 may comprise glass ampules or the like, including weakened portions if desired, and including one or more rupturable fluid barriers.

A first constituent of disabling material may be positioned within first chamber 129, whereas a second constituent of disabling material may be positioned within second chamber 135. Inner wall 127 may include therein at least one aperture 140, for example a plurality of apertures, configured to permit disabling material to interact with lead material 126 upon rupturing of the fluid barrier. In other words, when the materials contained within reactant vessels 128 and 130 are allowed to mix or are otherwise activated or released, holes 140 will provide a path by which disabling material can fluidly contact lead material 126 to disable the same.

In one embodiment, one of reactant vessels 128 and 130 will contain a solvent material such as water, and the other of reactant vessels 128 and 130 will contain a solute material such as dry sodium hydroxide. Upon rupturing of the fluid barrier of neutralizer 120, the solvent and solute can mix to create a liquid solution that flows via holes 140 to contact lead material 126 and dissolve or otherwise chemically disable activation thereof via a detonator. In constructing neutralizer 120, the relative fluid volume resulting from mixing of the constituents of the disabling material should be selected such that fluid contact via holes 140 will occur regardless of the orientation of an explosive device utilizing neutralizer 120. This concept will apply broadly to all embodiments, in that orientation of an unexploded explosive device should not substantially affect operation of the neutralizer.

It should further be appreciated that the particular chemical formulation chosen to interact with lead material 126 will depend upon the selected lead material. Certain lead materials are relatively more inert than others, and have different chemical properties. Thus, acidic solvents might be used rather than caustics. Similarly, rather than dissolving the lead energetic material, certain lead materials may be rendered inert via other types of chemical treatment and/or chemically induced physical changes such as liquefaction, gasification or decomposition. It may also be desirable for the chemicals used in each of the embodiments described herein to be active over a range of temperatures, such that disposition of an explosive device in a particularly hot environment versus a particularly cold environment will not substantially affect the ability of the neutralizer to function. In the embodiments described herein, chemical reaction between disabling material and lead material will typically take place via hydrolysis of the lead material in about one day or less at room temperature.

INDUSTRIAL APPLICABILITY

The present disclosure will provide significant advantages over known designs for disabling/neutralizing explosive devices, and is contemplated to be applicable to a wide variety of explosives both in terms of configuration and neutralizing effectiveness. The present disclosure will be applicable to substantially all explosive devices relying upon a fuze for activation. Rather than a passive disabling system that relies upon the passage of an uncertain amount of time, or manual intervention, to render certain components of an explosive device inoperative, the present disclosure provides an active method of relatively rapidly inhibiting operation of an explosive device when the device fails. Interaction of disabling material with a firing train may also take place via direct means, e.g. chemically attacking or otherwise modifying the lead energetic material or mechanically blocking the firing train via the disabling material, or via indirect means such as by displacing a member into the firing train, or otherwise blocking action of a firing train on a booster charge or main charge of an explosive device.

Most explosives for weapons or engineering purposes such as blasting are intended to detonate relatively rapidly when activating conditions are provided, typically on the order of a few milliseconds. The neutralizing devices and methods of the present disclosure are each specifically designed to disable such explosive devices in a period that is longer than the intended detonation time. For instance, while mixing, foaming, interaction with the firing train and ultimately curing of the disabling material in the FIGS. 1 and 4 embodiments will indeed take place relatively rapidly, an obligate delay is built into the strategy that is longer than the time normally required for activation and detonation of a conventional explosive device. Similarly, a certain amount of time, albeit typically relatively short, will be required for disabling of the lead material where chemical disabling is used. In this manner, neutralizers of the present disclosure will tend not to disable conventional explosive devices until the devices have had an opportunity to operate as intended. The neutralizers described herein are also relatively small, and compatible with existing explosive device designs essentially as a drop in component configured to couple with other portions of a firing train assembly. Embodiments are also contemplated wherein an explosive device has an external indicator such as a color-coded or LCD window which changes state in a user perceptible manner upon activation of the neutralizer.

The present description is for illustrative purposes only, and should not be construed to narrow the breadth of the present disclosure in any way. Thus, those skilled in the art will appreciate that various modifications might be made to the presently disclosed embodiments without departing from the full and fair scope of the present disclosure. For example, while it is contemplated that chemical foaming will provide a practical implementation strategy where mechanical interruption of an explosive firing train is desired, other approaches might be used within the context of the present disclosure, such as compressed gas within a rupturable canister. Further still, while the foregoing description of a neutralizer acting via chemical means emphasizes the use of separate reactants/constituents, it should be appreciated that a single disabling material which is capable of acting on the lead material in a desired manner might be used. Moreover, rather than a chemical contacting the lead material via housing apertures, the chemicals might dissolve a fluid barrier such as a foil positioned about the lead material. The present disclosure contemplates any means of directly or indirectly interacting with a firing train to disable the same, via rupturing of a rupturable fluid barrier responsive to an impact shock. Other aspects, features and advantages will be apparent upon an examination of the attached drawings and appended claims.

What is claimed is:

1. A neutralizer for a firing train of an explosive device comprising:

a housing having a first housing end which includes a detonator strike zone, a second housing end and a peripheral wall extending between the first housing end and the second housing end, the housing being adapted to couple with a portion of a firing train assembly and having therein a chamber for containing a disabling material, wherein the housing further includes an internal wall defining a lead compartment for containing a lead energetic material, the lead compartment having a lead compartment opening located at the second housing end; and a rupturable fluid barrier configured to inhibit interacting of disabling material contained within the chamber with said firing train;

said barrier being configured to rupture responsive to a shock on said neutralizer to permit interacting of disabling material with said firing train to disable the firing train.

2. The neutralizer of claim 1 further comprising at least one reactant vessel disposed within said housing, said at least one reactant vessel including said barrier and at least partially defining said chamber.

3. The neutralizer of claim 2 wherein said at least one reactant vessel comprises a glass ampule.

4. The neutralizer of claim 2 wherein said housing includes a first chamber and a second chamber therein, and wherein said at least one reactant vessel comprises a first and a second reactant vessel defining said first chamber and said second chamber, respectively, said first and second chambers being fluidly separated via said rupturable barrier and configured to fluidly communicate upon rupturing thereof to permit activating of said disabling material.

5. The neutralizer of claim 4 further comprising a displaceable element configured to move responsive to activation of said disabling material to mechanically inhibit said firing train.

6. The neutralizer of claim 5 wherein said displaceable element including a lead compartment covering configured to move via intrusion of activated disabling material between said lead compartment and said covering to block acting of a detonator on a lead energetic material of said firing train.

7. The neutralizer of claim 4 wherein said housing further comprises a second compartment wherein said first and second reactant vessels are disposed, and said internal wall separating said lead compartment from said second compartment and having openings therein configured to permit contacting of activated disabling material with a lead energetic material of said firing train.

8. An explosive device comprising:

a firing train;

an explosive charge; and a shock activated neutralizer configured to disable activation of said explosive charge, said neutralizer comprising a housing and a rupturable fluid barrier configured to selectively permit interacting of disabling material with said firing train to disable the firing train;

wherein said firing train comprises a detonator, a lead energetic material and a booster charge, said shock activated neutralizer being configured to disable activation of said lead energetic material responsive to a shock on said explosive device.

9. The explosive device of claim 8 wherein said neutralizer is configured to mechanically inhibit activation of said lead energetic material by said detonator at least in part via activation of said disabling material upon rupturing of said barrier.

10. The explosive device of claim 9 wherein said neutralizer further comprises:

at least one reactant vessel defining a first chamber;

a second chamber fluidly separated from said first chamber via said rupturable fluid barrier;

a foamable, curable material and an activator material contained one within each of said first and second chambers; and at least one displaceable element configured to move responsive to activation of said disabling material.

11. The explosive device of claim 10 wherein said foamable, curable material comprise a polyurethane material, and wherein said activator comprises water.

12. The explosive device of claim 9 wherein said neutralizer is configured to chemically disable activation of said lead energetic material by said detonator.

13. The explosive device of claim 12 wherein said neutralizer further comprises:

at least one reactant vessel defining a first chamber;

a second chamber fluidly separated from said first chamber via said rupturable fluid barrier;

a solvent material and a solute material contained one within each of said first and second chambers;

said housing having a first compartment containing said at least one reactant vessel and a second compartment containing said lead energetic material, and including means for providing fluid communication between said first and second compartments to permit contacting of said solution with said lead energetic material.

14. The explosive device of claim 13 wherein said solvent comprises water, and wherein said solute comprises sodium hydroxide.

15. A method of neutralizing an explosive device comprising the steps of:

rupturing a fluid barrier in a neutralizer of the explosive device configured to inhibit interacting of a disabling material with a firing train of the explosive device, at least in part by applying a shock to the explosive device; and interacting the disabling material with the firing train of the explosive device to disable the firing train.

16. The method of claim 15 further comprising a step of activating the disabling material at least in part by providing fluid communication between a first reactant chamber and a second reactant chamber of a firing train neutralizer separated by the barrier.

17. The method of claim 16 wherein the interacting step comprises chemically inhibiting activation of a lead energetic material of the firing train by a detonator.

18. The method of claim 16 wherein the interacting step comprises mechanically inhibiting activation of a lead energetic material of the firing train by a detonator at least in part via a displaceable element of the neutralizer.

19. The method of claim 18 wherein mechanically inhibiting activation of the lead energetic material includes moving a piston from a first position at which the piston does not block acting of the detonator on the lead energetic material to a second position at which the piston blocks acting of the detonator on the lead energetic material.

* * * * *